US007687732B1

(12) United States Patent
Tabata

(10) Patent No.: US 7,687,732 B1
(45) Date of Patent: Mar. 30, 2010

(54) KEY SWITCH EXHIBITING LOW NOISE OPERATION

(75) Inventor: Masayuki Tabata, Kanagawa (JP)

(73) Assignee: Minebea Co., Ltd. (JP)

( * ) Notice: Subject to any disclaimer, the term of this patent is extended or adjusted under 35 U.S.C. 154(b) by 0 days.

(21) Appl. No.: 12/173,735

(22) Filed: Jul. 15, 2008

(51) Int. Cl.
*H01H 13/70* (2006.01)

(52) U.S. Cl. ..... 200/345; 200/341

(58) Field of Classification Search ..... 200/5 A, 200/517, 341, 344, 345; 400/490, 491, 491.2, 400/495, 495.1, 496
See application file for complete search history.

(56) References Cited

U.S. PATENT DOCUMENTS 5,406,277 A * 4/1995 Lee ..... 341/22
5,516,996 A 5/1996 Shin
5,794,762 A 8/1998 Tsai
6,121,564 A * 9/2000 Huang ..... 200/345
6,171,003 B1 * 1/2001 Lo ..... 400/495
6,204,462 B1 * 3/2001 Huang ..... 200/345
6,242,705 B1 * 6/2001 Huang ..... 200/520
6,300,582 B1 * 10/2001 Huang ..... 200/302.2
6,610,948 B1 * 8/2003 Tsau ..... 200/345
6,969,815 B1 * 11/2005 Lu ..... 200/345
6,998,554 B2 * 2/2006 Shimoda et al. ..... 200/341
7,102,087 B2 * 9/2006 Chun et al. ..... 200/5 A
7,138,593 B2 * 11/2006 Toyoda ..... 200/345
7,462,796 B1 * 12/2008 Chai ..... 200/341

* cited by examiner

*Primary Examiner*—Michael A Friedhofer
(74) *Attorney, Agent, or Firm*—Townsend and Townsend and Crew LLP

(57) ABSTRACT

A keyswitch apparatus features a key cap having a stem slidably moveable within a housing of a keyboard frame, to interact with an underlying membrane switch. According to one embodiment, the stem is square and at least two sets of channel-like guides on opposite sides of the stem are configured to be in sliding engagement with corresponding ribs projecting from the housing. Sliding engagement between the ribs and corresponding guides serves to minimize points of contact between the key cap and housing, reducing noise of operation. The rigid ribs and corresponding guides are relatively simple shapes that facilitate their fabrication with precise dimensional tolerances.

20 Claims, 10 Drawing Sheets

KEY SWITCH EXHIBITING LOW NOISE OPERATION

BACKGROUND OF THE INVENTION

Embodiments in accordance with the present invention are directed to computing devices. More particularly, embodiments of the present invention provide a keyboard switch exhibiting desirable properties such as low noise operation. Merely by way of example, the invention has been applied to a keyboard apparatus for a desk top computer, although it can also be applied to a laptop computer, modular computer, and other computing devices.

Computing devices have proliferated. In the early days, large mainframe computers dominated the computing landscape. These large mainframe computers were developed by companies such as IBM Corporation of Armonk, N.Y. Mainframe computers have been replaced, at least in part, by smaller computing devices, commonly known as "PCs." PCs come in various shapes and sizes. PCs are often run using computer software such as XP™ from Microsoft Corporation from Redmond Wash. Other types of computer software come from Apple Computer of Cupertino, Calif. Smaller PC versions are often called "lap top computers." Other types of PCs include larger desktop versions. Still other versions of PCs can be found in smaller devices such as personal digital assistants, called PDAs, cellular phones, and a variety of other applications.

All of these computing devices generally require input devices for human users to interact with them. As merely an example, computer keyboards are most commonly used as such input devices for inputting characters, numerals and symbols to electronic devices, particularly to these computing devices such as the PCs. In such keyboards, an input signal is typically generated by manual depression of a key of a keyswitch device.

FIG. 1A is a simplified exploded view of a conventional key switch apparatus 1. FIG. 1B is a simplified top view of the conventional key switch of FIG. 1A. FIG. 1C is a simplified cross-sectional view of the conventional key switch of FIG. 1A.

The conventional keyboard carries two or more key housings 11*a* located in a keyboard panel 10*a*. An inner side of key housing 11*a* includes a sliding portion in squared chimney form.

Key housing 11*a* is configured to receive key cap 12*a*. Specifically, key cap 12*a* includes stem 13*a* having a squared chimney form in a lower part thereof. Prism 14*a* of key cap 12*a* is formed in the four corners of the key cap stem.

The four corners inside prism 14*a* and housing 11*a* contact and slide against one another. Lubricating oil may be applied to four corners of housing 11*a* so that key cap 12*a* may move smoothly during this sliding operation.

In operation, when a user touches the keys of key cap 12*a* with a finger, stem 13*a* descends within the inside of housing 11*a*. As a result, rubber dome 15*a* follows and descends, and membrane switch 16*a* underlying rubber dome 15*a* is pushed in and a signal is inputted.

For the conventional key switch apparatus 1 shown in FIGS. 1A-C, it is particularly important that the dimension alpha ($\alpha$) of a sliding part in the chimney formed inside of housing 11*a*, and distance beta ($\beta$) between prisms 14*a* of key cap 12*a* are, dimensionally accurate. Specifically, if a clearance between them is too narrow (for example because of lack of stability during forming conditions or construction of these parts from plastic resin), key cap 12*a* may become difficult to move or even stuck.

On the other hand, when a clearance between the key cap and the housing is too large, a relatively loud noise may result. Specifically, because key cap 12*a* becomes unsteady, contact noise of four corners of prism 14*a* and housing 11*a* arises, and may resonate and be amplified within stem 13*a*.

From the above, it is seen that improved designs for key switches for keyboards are highly desirable.

BRIEF SUMMARY OF THE INVENTION

According to embodiments of the present invention, techniques for computing devices are provided. More particularly, embodiments in accordance with the invention provide a keyboard apparatus and related methods configured to exhibit low noise operation. Merely by way of example, embodiments in accordance with the present invention have been applied to a keyboard apparatus for a desk top computer, although it can also be applied to a laptop computer, modular computer, and other computing devices.

In accordance with one embodiment, a keyswitch apparatus features a key cap having a stem slidably moveable within a housing of a keyboard frame, to interact with an underlying membrane switch. Channel-like guides present on opposite sides of the stem of the key cap, are configured to receive rigid ribs projecting from the housing, Sliding engagement between the ribs and corresponding guides serves to minimize points of contact between the key cap and housing, reducing noise of operation. The rigid ribs and corresponding guides are relatively simple shapes that facilitate their fabrication with precise dimensional tolerances.

Various additional objects, features and advantages of the present invention can be more fully appreciated with reference to the detailed description and accompanying drawings that follow.

DETAILED DESCRIPTION OF THE INVENTION

A keyswitch apparatus exhibiting reduced noise features a rib in sliding engagement between a pair of channel-like guides. A particular embodiment features a key cap having a stem slidably moveable within a housing of a keyboard frame, against an underlying membrane switch. In one embodiment, two pairs of channel-like guides are present on opposite sides of the key cap stem, and are configured to receive corresponding rigid ribs projecting from the housing. Interaction between the ribs and guides serves to minimize points of contact between the key cap and housing, reducing noise of operation. The rigid ribs and corresponding guides are relatively simple shapes that facilitate their fabrication with precise dimensional tolerances.

Figure 1A:
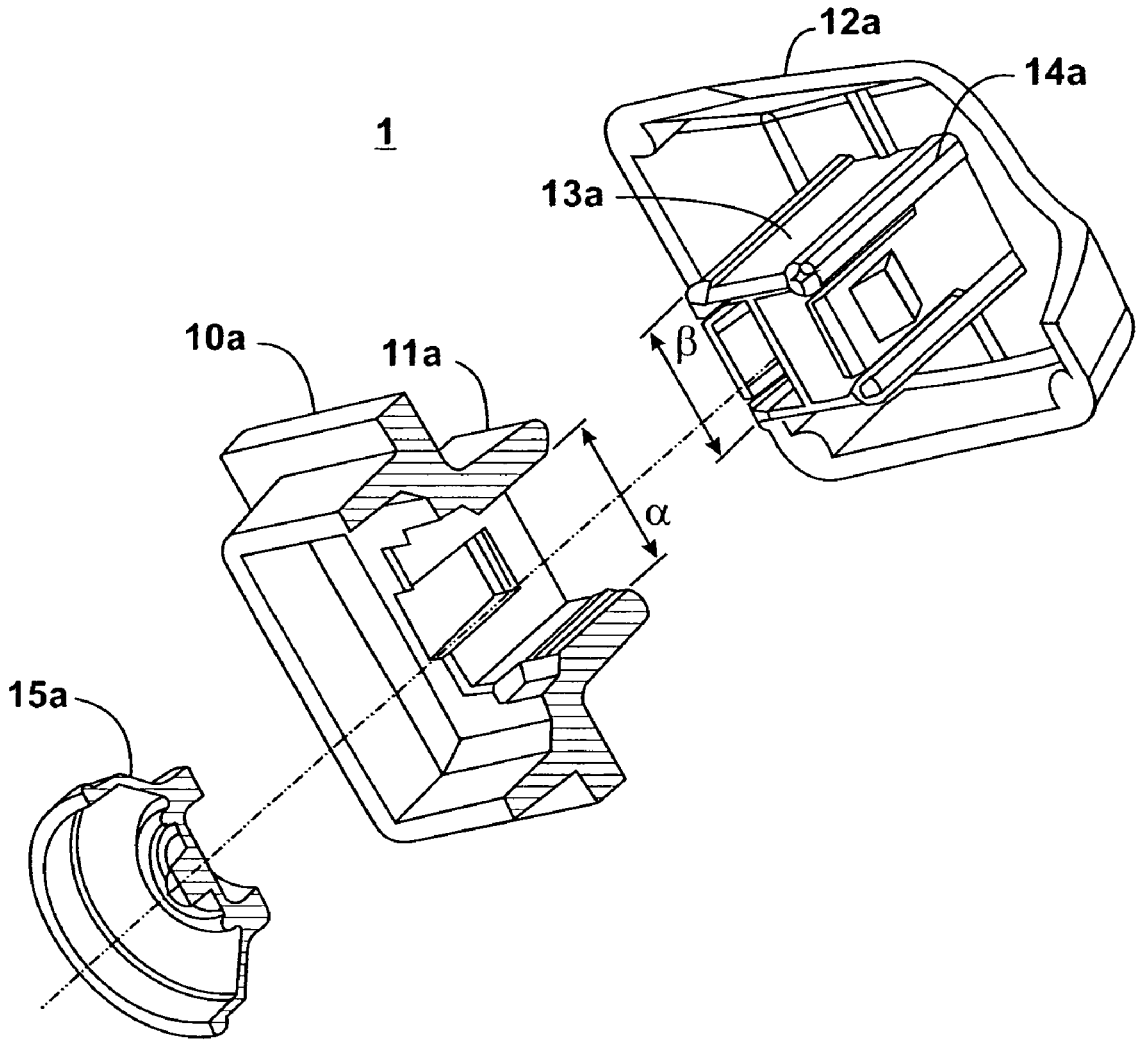
FIG. 1A is a simplified exploded view of a conventional key switch.
Figure 1B:
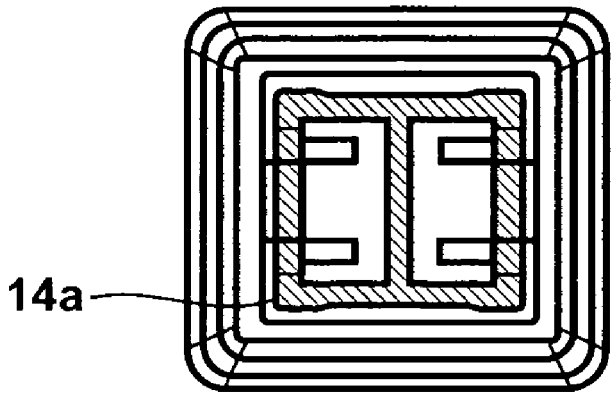
FIG. 1B is a simplified top view of the conventional key switch of FIG. 1A.
Figure 1C:
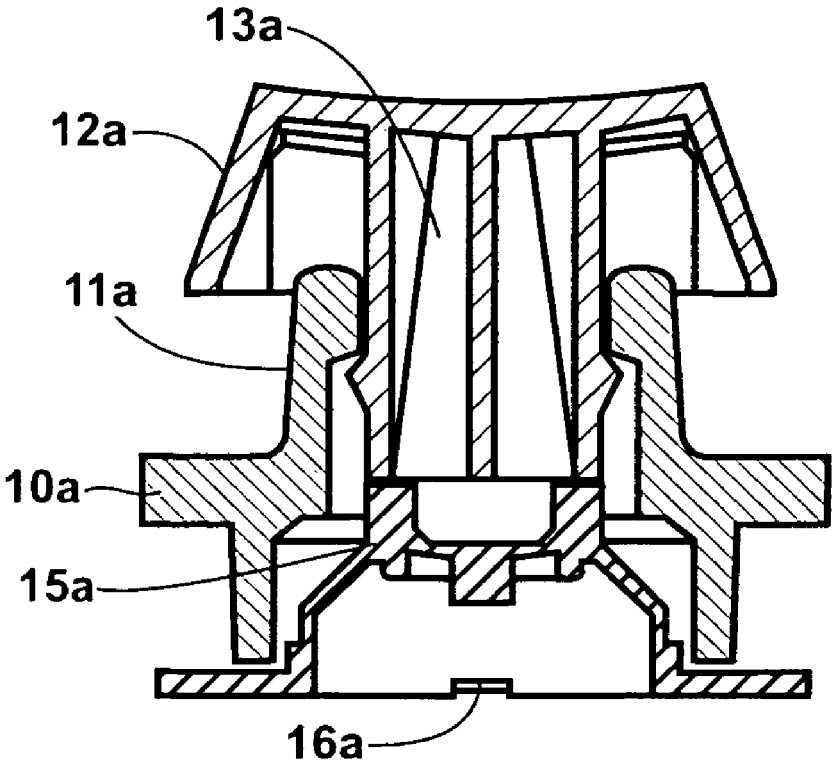
FIG. 1C is a simplified cross-sectional view of the conventional key switch of FIG. 1A.
Figure 2A:
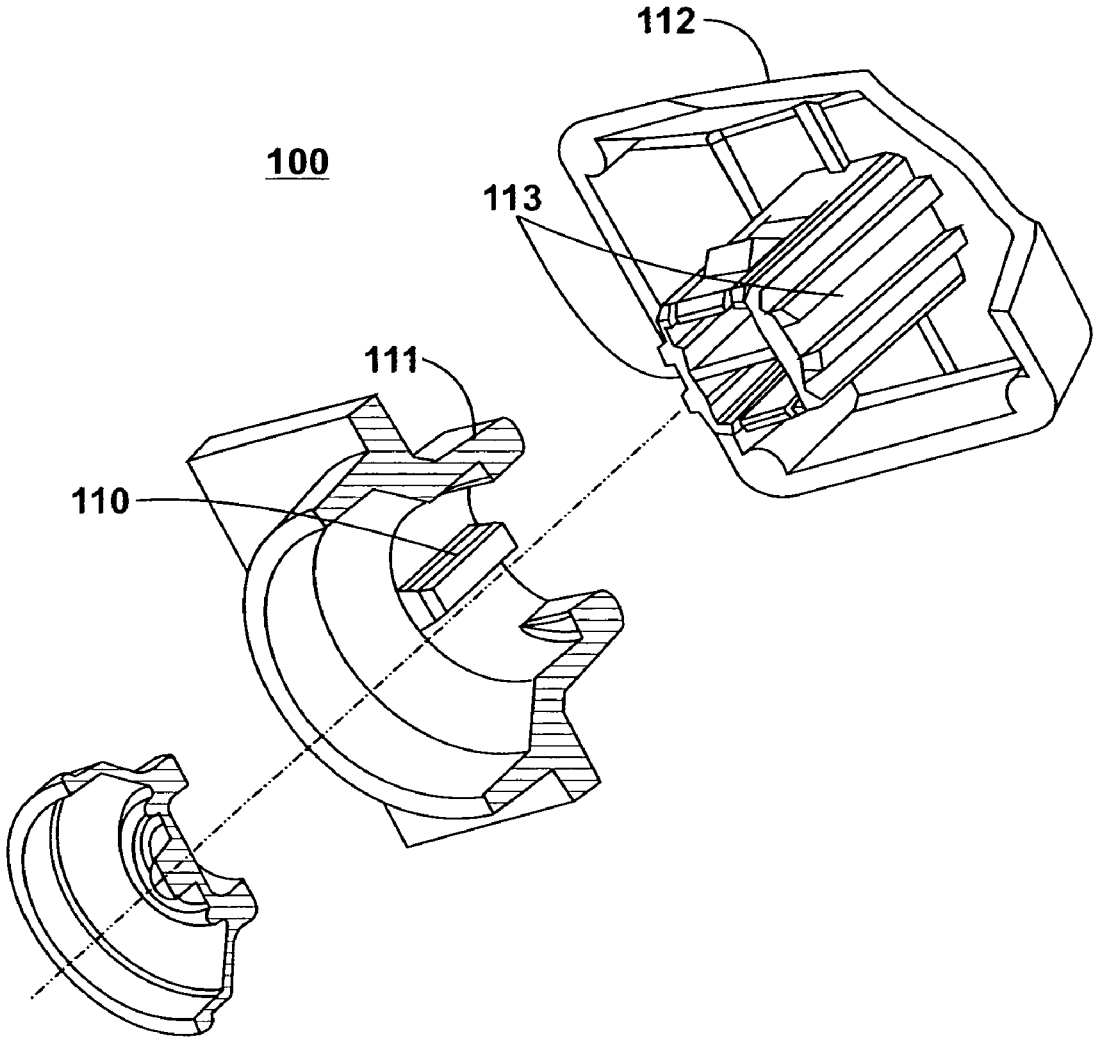
FIG. 2A is a simplified exploded view of a key switch according to an embodiment of the present invention.
Figure 2B:
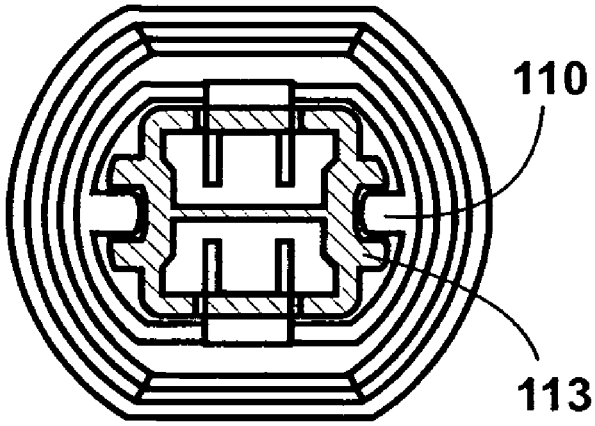
FIG. 2B is a simplified top view of the key switch of FIG. 2A.
Figure 2C:
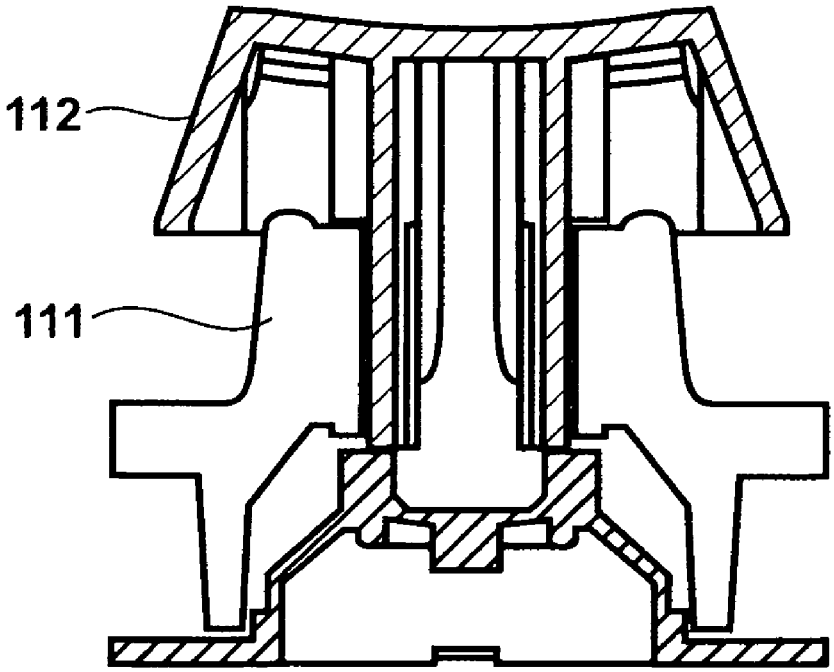
FIG. 2C is a simplified cross-sectional view of the key switch of FIG. 2A.

FIG. 2A is a simplified exploded view of a key switch apparatus 100 according to an embodiment of the present invention. FIG. 2B is a simplified top view of the key switch of FIG. 2A. FIG. 2C is a simplified cross-sectional view of the key switch of FIG. 2A.

The keyboard carries two or more key housings 111 located in a keyboard panel 110. An inner side of key housing 111 includes a sliding portion.

Key housing 111 is configured to receive key cap 112. Specifically, key cap 112 includes stem 113. In operation, when a user touches the keys of key cap 112 with a finger, stem 113 descends within the inside of housing 111. As a result, rubber dome 115 follows and descends, and membrane switch 116 underlying rubber dome 115 is pushed in and a signal is inputted.

In the key switch apparatus 100, opposite sides of a sliding part of the housing 111 are formed in the shape of a rail by rigid ribs 110. A sliding portion of key cap 112 is formed with corresponding guides 113 that are channel shaped and configured to receive the ribs 110 of the housing 111.

Figure 3:
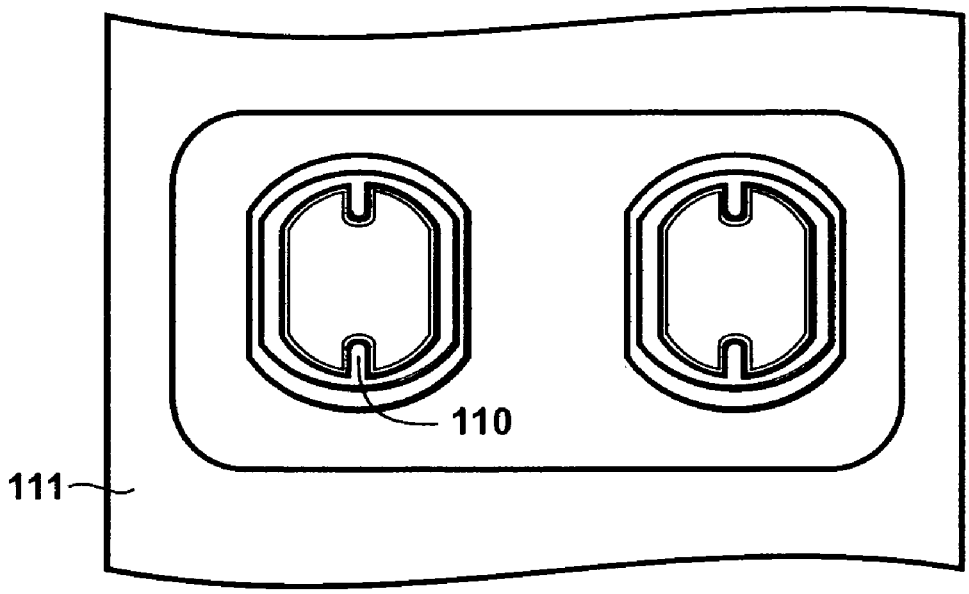
FIG. 3 is a photograph of an embodiment of a housing in accordance with the present invention featuring a projecting rib.
Figure 4:
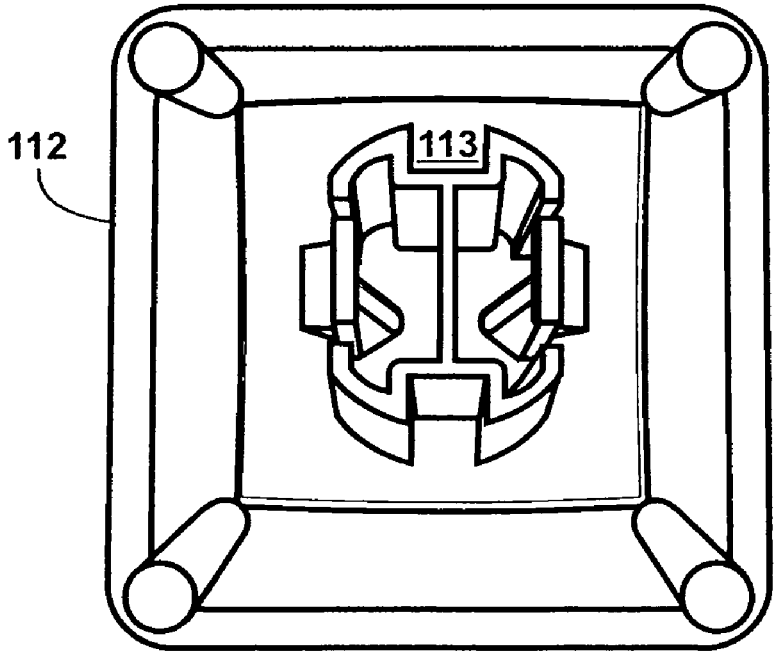
FIG. 4 is a photograph of an embodiment of a keycap in accordance with the present invention featuring a guide to receive the projecting rib shown in FIG. 3.

FIG. 3 is a photograph of an embodiment of a housing 111 in accordance with the present invention featuring the projecting ribs 110. FIG. 4 is a photograph of an embodiment of a keycap 112 in accordance with the present invention featuring the corresponding guides 113 configured to receive the projecting ribs shown in FIG. 3.

The embodiment of the key switch shown in FIGS. 2A-4 above may result in a number of possible benefits. One benefit is that the source of contact noise can be reduced over the conventional structure, by cutting down the number of points of contact from four to two. Specifically, rather than having the conventional four prisms of the chimney regions sliding against the corners of the housing, in the design shown only two ribs slide within the channel guides.

Moreover, since the sliding part is made in the relatively simple form of a projecting rib, there is little variation in a dimension by forming conditions or contraction of plastic resin, for example in the narrow space characteristic of a tight corner. Accordingly, clearance between a rib 110 and a corresponding guide 113 can be maintained relatively constant.

Figure 5A:
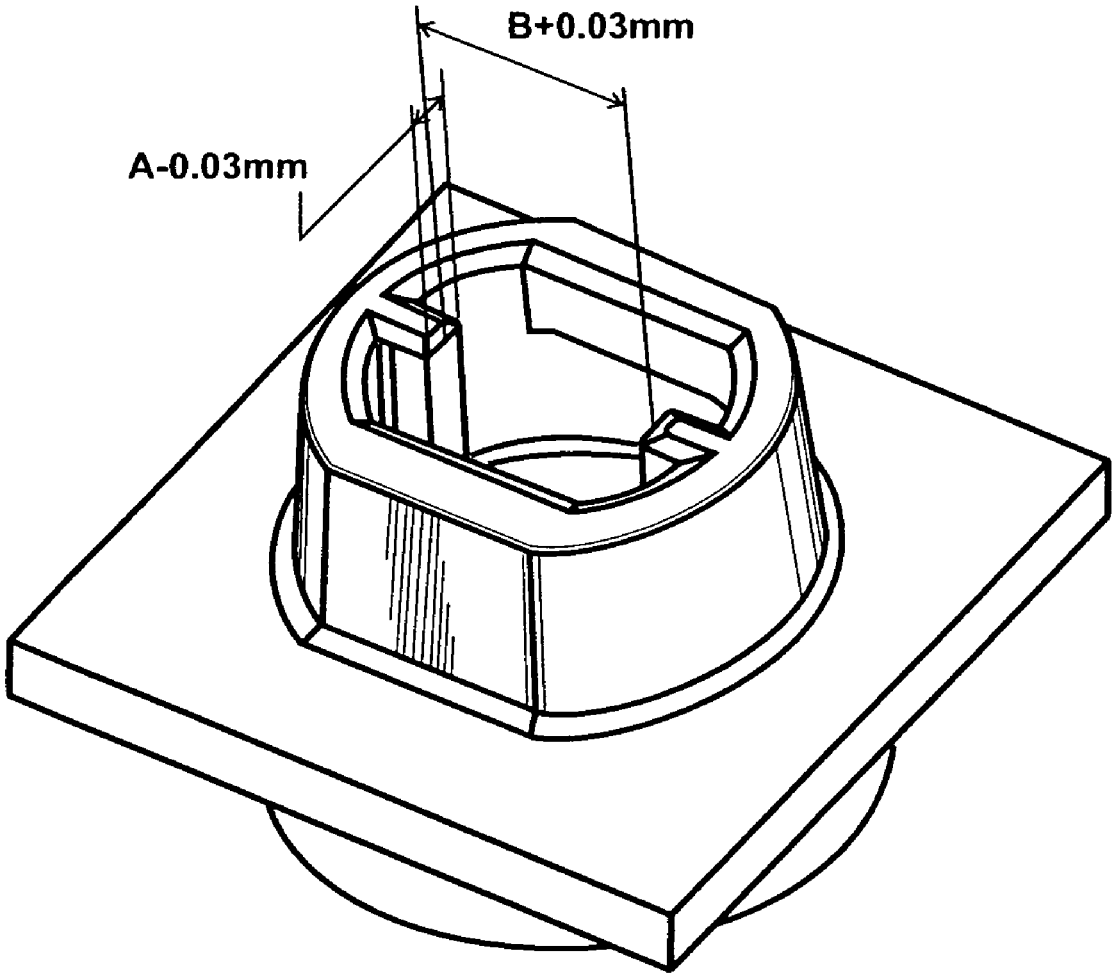
FIG. 5A shows the dimensional tolerance of a housing according to one embodiment of the present invention.

For example, FIG. 5A shows the dimensional tolerance of a key housing according to one embodiment of the present invention. As shown in this view, the housing includes a pair of ribs having a width, which can be less than an absolute target width A by about 0.03 mm or less. The distance between the ends of the oppositely disposed ribs is specified to permissibly be larger than an absolute target distance B by up to about 0.03 mm.

Figure 5B:
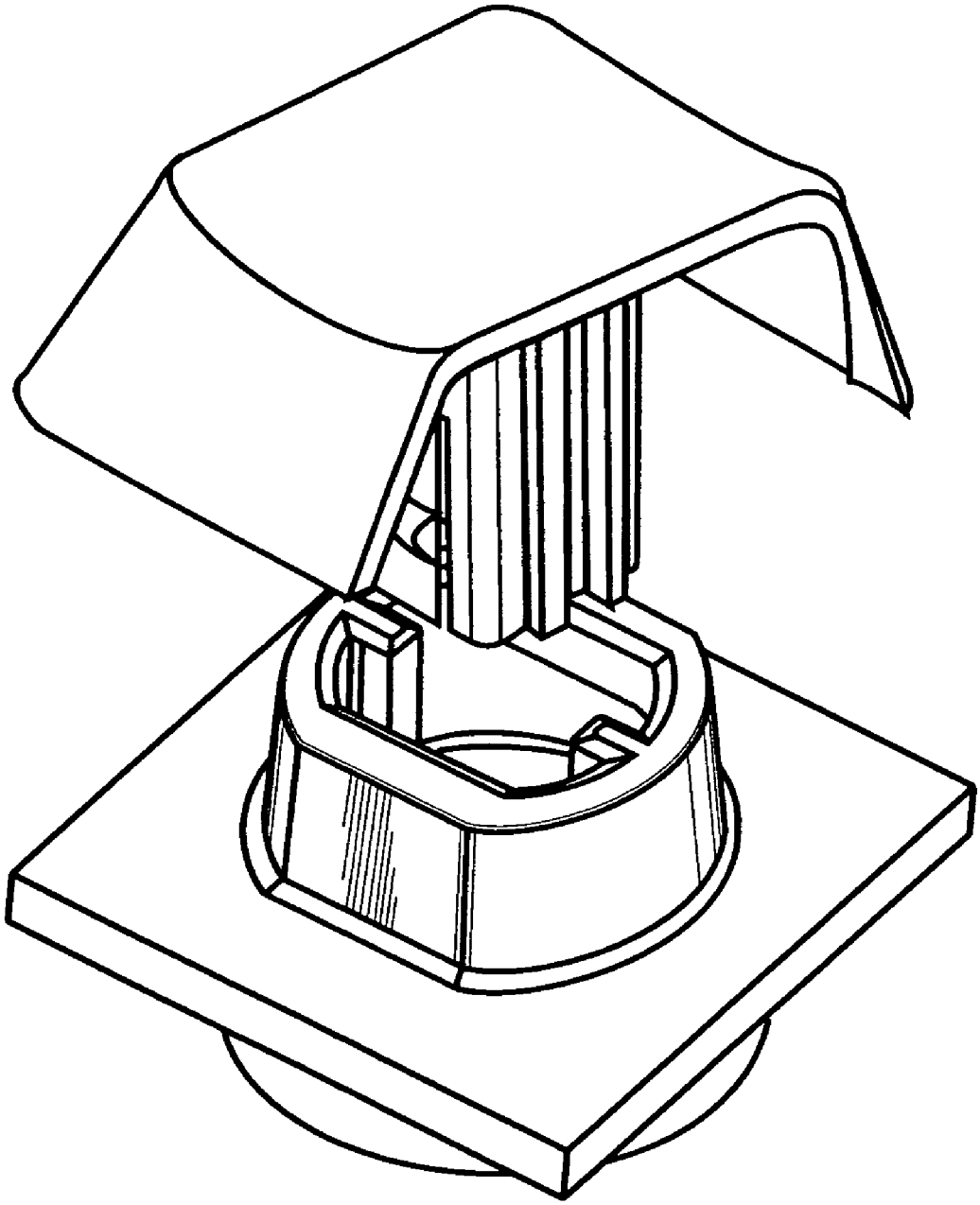
FIG. 5B shows the dimensional tolerance of a corresponding keycap according to the embodiment of FIG. 5A.
Figure 5C:
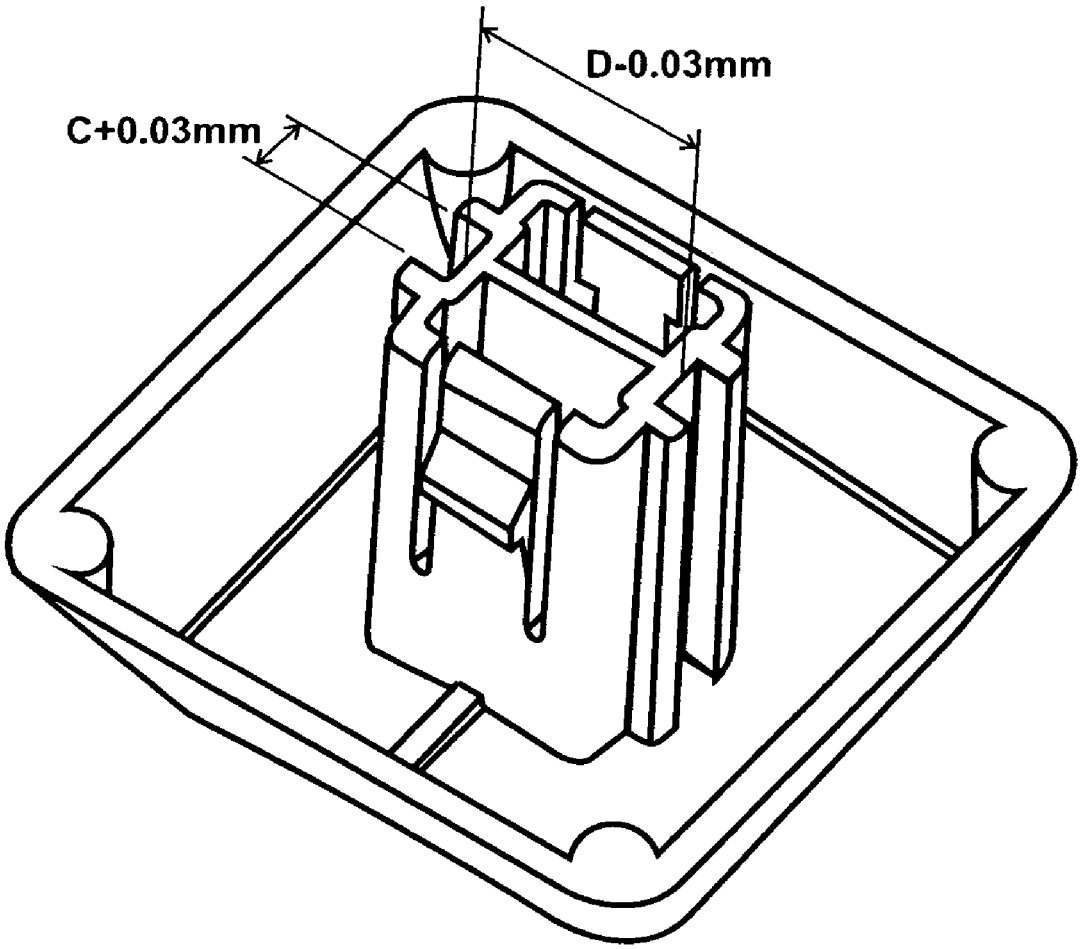
FIG. 5C shows mating between the housing and the keycap of the embodiment of FIGS. 5A-B.

FIG. 5B shows mating between the housing of FIG. 5A and a corresponding key cap in an embodiment exhibiting low noise. FIG. 5C shows the dimensional tolerance of the key cap of FIG. 5B. Specifically, the guides in the sides of the key cap that are configured to receive the rails on the sides of the housing, are formed at a width that can be greater than an absolute target width C by up to about 0.03 mm. The distance across the key cap stem that is configured to fit within the oppositely disposed rails of the housing, may be less than an absolute target distance D by up to about 0.03 mm.

In accordance with certain embodiments, a low noise key switch may exhibit a noise of actuation of about 45 decibels. Examples of actuation noise exhibited by particular embodiments are 45 decibels, 46 decibels, or 47 decibels. This noise of actuation compares favorably with that of conventional key switch designs, which typically exhibit a noise of actuation of about 50 decibels or more.

By ensuring a close fit between the key cap and the housing, looseness and resulting tottering motion of a key cap is reduced. This improved fit between the housing and the key cap in turn reduces any noise of contact between them, providing reduced noise operation.

While the preferred embodiments of the invention have been illustrated and described, it will be clear that the invention is not limited to these embodiments only. Numerous modifications, changes, variations, substitutions and equivalents will be apparent to those skilled in the art without departing from the spirit and scope of the invention as described in the claims.

Figure 6:
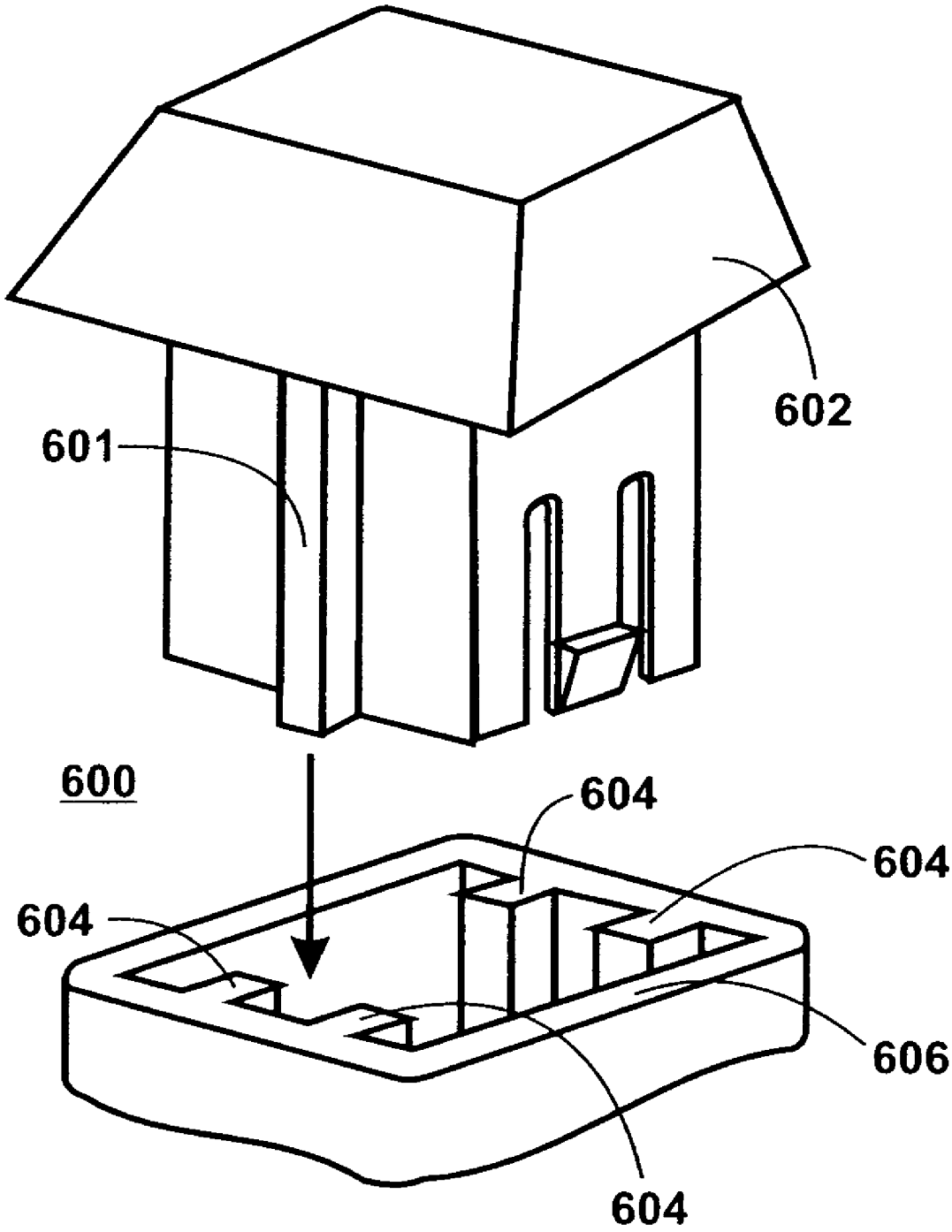
FIG. 6 shows a simplified perspective view of mating between the housing and a keycap in accordance with an alternative embodiment of the present invention.

For example, while the specific embodiment illustrated above features ribs projecting from the housing in sliding engagement with respective guides in the key cap, this is not required by the present invention. In accordance with alternative embodiments, the key switch could feature ribs on the key cap that engage with guides defined by the housing. Such an alternative embodiment is shown in the simplified perspective view of key switch 600 of FIG. 6, wherein ribs 601 on the stem of the key cap 602 are configured to engage with guides 604 defined by housing 606.

Moreover, while the particular embodiment shown and described above features pairs of ribs/guides disposed on only opposite sides of the key caps and housings, this is not required by the present invention. In accordance with an alternative embodiment, the guides and rails could be provided on adjacent sides of a rectangular, square, or polygonal key cap/housing configuration, and remain within the scope of the present invention. Such an alternative embodiment is shown in the simplified perspective view of key switch 700 of FIG. 7, wherein ribs 701 on adjacent sides of the stem of the key cap 702 are configured to engage with corresponding pairs of guides 704 located on adjacent sides of the housing 706.

Figure 7:
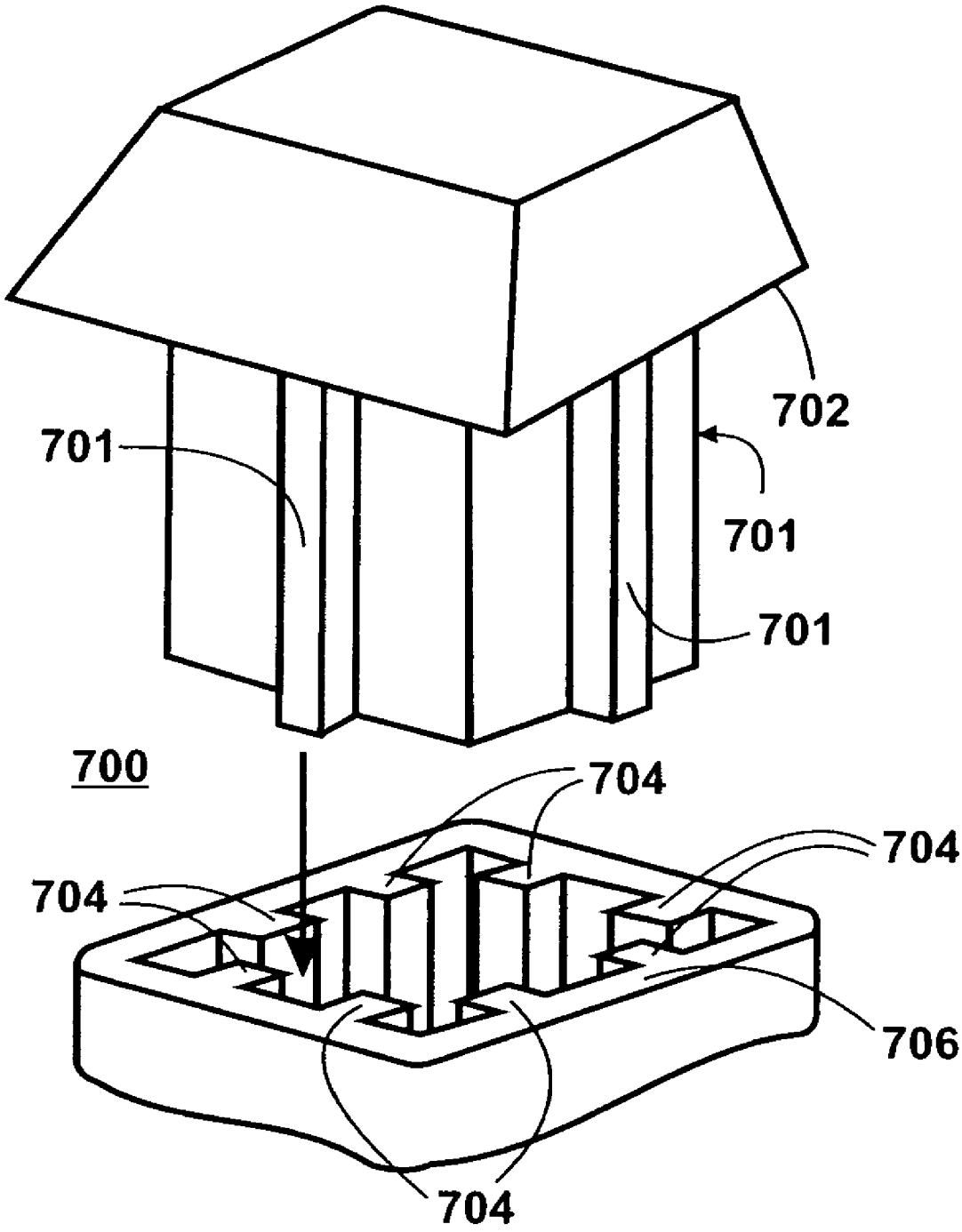
FIG. 7 shows a simplified perspective view of mating between the housing and a keycap in accordance with an alternative embodiment of the present invention.

The particular embodiment of FIG. 7 also depicts a rib 701 and corresponding pair of guides 704 provided on an opposite side.

Still further alternative embodiments may utilize more than two sets of respective ribs and guides. In accordance with an alternative embodiment, guides and corresponding ribs could be provided on three or more sides of a rectangular, square, or polygonal key cap/housing configuration, and remain within the scope of the present invention.

Merely by way of example, the invention has been applied to a keyboard apparatus for a desk top computer, although it can also be applied to a laptop computer, modular computer, and other computing devices.

What is claimed is:

1. A key switch comprising:

a housing defining an opening having a first side defining a first projecting rib having a uniform actual width and a second side defining a second projecting rib having the uniform actual width, the first projecting rib separated from the second projecting rib by an actual separation, and a key cap comprising a stem having a first side defining a first pair of channel-like guides configured to be in sliding engagement with the first projecting rib, and having a second side defining a second pair of channel-like guides configured to be in sliding engagement with the second projecting rib, the first pair of channel-like guides spaced from each other by a actual uniform spacing, the second pair of channel-like guides spaced from each other by the actual uniform spacing, and the first pair of channel like guides separated from the second pair of channel-like guides by an actual distance; and a membrane switch disposed interact with the stem when the stem is slid within the housing, wherein the actual width may be within 0.03 mm or less of a target width, the actual separation may be within 0.03 mm or less of a target separation, the actual spacing may be within 0.03 mm or less of a target spacing, and the actual distance may be within 0.03 mm or less of a target distance, such that the actual key switch exhibits a noise of about 47 decibels or less when actuated.

2. The key switch of claim 1 wherein the opening and the stem are in the shape of a rectangle or square, and the first and second sides are adjacent.

3. The key switch of claim 1 wherein the opening and the stem are in the shape of a rectangle or square, and the first and second sides are opposite to one another.

4. The key switch of claim 1 wherein the opening and the stem are polygonal in shape and the first and second sides are adjacent.

5. The key switch of claim 1 wherein the opening and the stem are polygonal in shape and the first and second sides are not adjacent.

6. The key switch of claim 1 wherein one of the housing and the ribs comprise a molded resin material.

7. The key switch of claim 1 further comprising a flexible dome disposed between the stem and the membrane switch.

8. The key switch of claim 7 wherein the dome is rubber.

9. A key switch comprising:

a housing defining an opening having a first side defining a first pair of channel-like guides, and having a second side defining a second pair of channel-like guides, the first pair of channel-like guides offering an actual uniform spacing, and the second pair of channel-like guides offering the actual uniform spacing, the first and second pair of channel-like guides separated from each other by an actual distance; and a key cap comprising a stem having a first side defining a first rib of an actual uniform width configured to be in sliding engagement with the first pair of channel-like guides, and having a second rib of the actual uniform width separated from the first rib by an actual separation and configured to be in sliding engagement with the second pair of channel-like guides; and a membrane switch disposed interact with the stem when the stem is slid within the housing, wherein the uniform actual width is within 0.03 mm or less of a target width, the actual separation is within 0.03 mm or a target separation, the spacing is within 0.03 mm or less of a target spacing, and the distance is within 0.03 mm or less of a target distance, wherein the key switch exhibits a noise of about 47 decibels or less when actuated.

10. The key switch of claim 9 wherein the opening and the stem are in the shape of a rectangle or square, and the first and second sides are adjacent.

11. The key switch of claim 9 wherein the opening and the stem are in the shape of a rectangle or square, and the first and second sides are opposite to one another.

12. The key switch of claim 9 wherein the opening and the stem are polygonal in shape and the first and second sides are adjacent.

13. The key switch of claim 9 wherein the opening and the stem are polygonal in shape and the first and second sides are not adjacent.

14. The key switch of claim 9 wherein one of the housing and the ribs comprise a molded resin material.

15. The key switch of claim 9 further comprising a flexible dome disposed between the stem and the membrane switch.

16. The key switch of claim 15 wherein the dome is rubber.

17. A method of reducing noise generated by a key switch, the method comprising:

providing a housing having an opening defining a first side having a first projecting rib having a uniform actual width and a second side having a second projecting rib having the uniform actual width, the first projecting rib separated from the second projecting rib by an actual separation; and providing a key cap having two pairs of channel-like guides each offering an uniform actual spacing, the pairs of channel-like guides separated from each other by an actual distance and disposed on a stem in sliding engagement with the first and second projecting ribs, wherein the uniform actual width is within 0.03 mm or less of a target width, the actual separation is within 0.03 mm or a target separation, the spacing is within 0.03 mm or less of a target spacing, and the distance is within 0.03 mm or less of a target distance, wherein the key switch exhibits a noise of about 47 decibels or less when actuated.

18. The method of claim 17 wherein the first and second sides are opposite one another.

19. A method of reducing noise generated by a key switch, the method comprising:

providing a housing having an opening defining a first side having a first channel-like guide and a second side having a second channel-like guide, the first and second channel-like guides each offering an actual uniform spacing, the first and second pairs of channel-like guides separated from each other by an actual distance and; and providing a key cap having ribs of an actual width disposed on a stem in sliding engagement with the first and second channel-like guides, the ribs separated from each other by an actual separation, wherein the uniform actual width is within 0.03 mm or less of a target width, the actual separation is within 0.03 mm or a target separation, the spacing is within 0.03 mm or less of a target spacing, and the distance is within 0.03 mm or less of a target distance, wherein the key switch exhibits a noise of about 47 decibels or less when actuated.

20. The method of claim 19 wherein the first and second sides are opposite one another.

* * * * *